United States Patent [19]

Rookus

[11] 4,003,130

[45] Jan. 18, 1977

[54] HAIR RAISING PANEL FOR ELECTRIC SHAVERS

[76] Inventor: James E. Rookus, 2902 Marshall SE., Apt. E-11, Grand Rapids, Mich. 49508

[22] Filed: Dec. 24, 1975

[21] Appl. No.: 644,142

Related U.S. Application Data

[63] Continuation-in-part of Ser. No. 478,620, June 12, 1974, Pat. No. 3,940,851.

[52] U.S. Cl. ..... 30/34.2; 30/43.92

[51] Int. Cl.² ..... B26B 19/10

[58] Field of Search ..... 30/34.2, 43.1, 43.91, 30/43.92, 346.51

[56] References Cited

UNITED STATES PATENTS

| | | | |
|---|---|---|---|
| 2,300,140 | 10/1942 | Tepas | 30/43.92 X |
| 2,323,084 | 6/1943 | Berg | 30/34.2 X |
| 2,973,574 | 3/1961 | Kobler | 30/346.51 X |
| 3,002,276 | 10/1961 | Kobler | 30/346.51 X |
| 3,088,205 | 5/1963 | Ellis | 30/34.2 X |
| 3,201,178 | 8/1965 | Okubo | 30/43.92 X |

FOREIGN PATENTS OR APPLICATIONS

| | | | |
|---|---|---|---|
| 907,106 | 10/1962 | United Kingdom | 30/43.92 |

*Primary Examiner*—Gary L. Smith
*Attorney, Agent, or Firm*—Price, Heneveld, Huizenga & Cooper

[57] ABSTRACT

A panel-like member is provided for an electric shaver which seats against the inside surfaces of the shaver screen which panel has a top surface positioned at or just below the upper shearing plane of the blade. The top surface of the panel positions the hairs as they enter the screen and blade such that they will be sheared by the blade.

16 Claims, 19 Drawing Figures

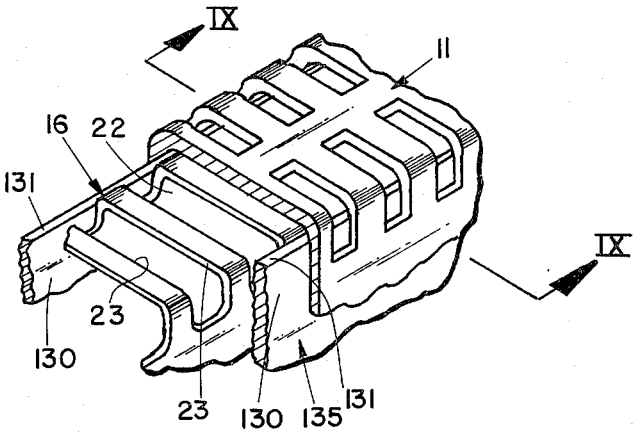
FIG 8
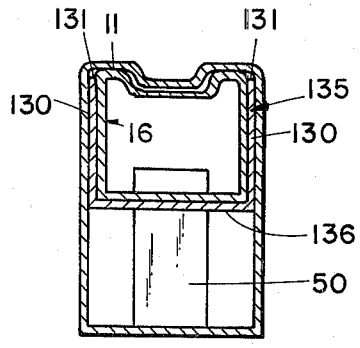
FIG 9
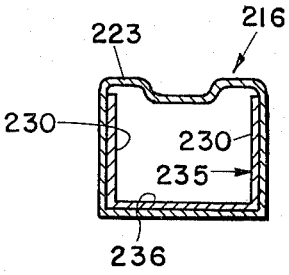
FIG 13
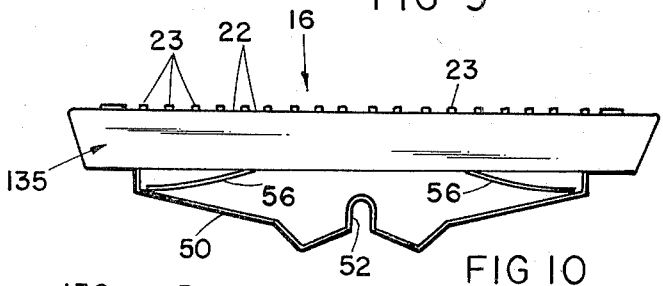
FIG 10
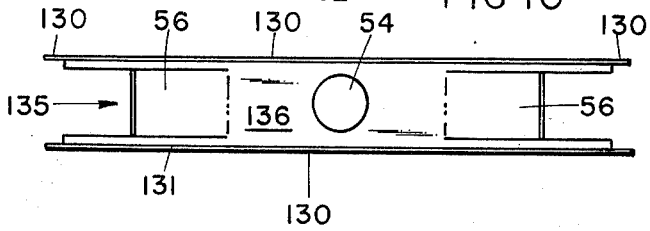
FIG 11
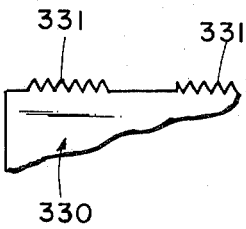
FIG 17
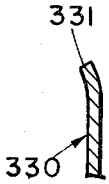
FIG 18
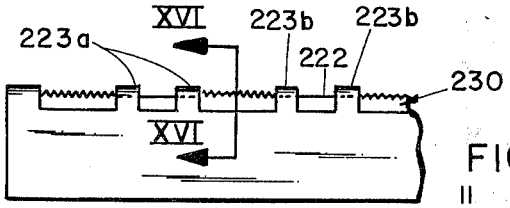
FIG 14
FIG. 19
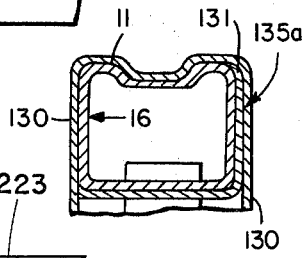
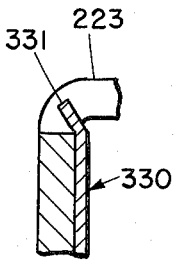
FIG 16
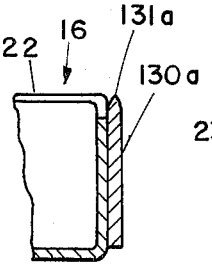
FIG 12
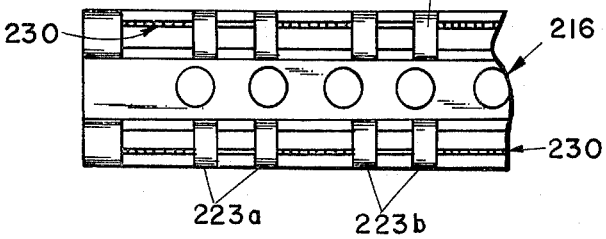
FIG 15

HAIR RAISING PANEL FOR ELECTRIC SHAVERS

CROSS REFERENCE TO RELATED APPLICATION

This is a continuation-in-part of application Ser. No. 478,620, filed June 12, 1974 now Pat. No. 3,940,851 entitled HAIR RAISING PANEL FOR ELECTRIC RAZOR.

BACKGROUND OF THE INVENTION

Electric shavers have a stationary apertured screen or guard behind which a driven blade is reciprocated or rotated to shave the user by shearing the individual hairs which project through the openings in the screen. The cutting blade is caused to move rapidly while pressed against the inside surface of the screen. The cutting blade has openings which permit the hairs which pass through the screen to also pass through the cutting blade whereby the hairs are sheared as the cutting blade passes across the screen openings. These openings are in the top of the screen and extend down the sides of the screen below the plane of the inside surface of the screen where the shearing action takes place.

For efficient shaving, ideally, the hairs should be erect and generally normal to the skin. However, this is an ideal only, since in many cases the hair grows at an acute angle to the skin and, therefore, as the shaver head approaches the hair, the hair is folded down between the exterior surface of the screen and the skin surface and never passes through the screen openings. The result is a poor shave, because only a portion of the hairs are actually cut. This has been the source of considerable irritation and frustration to both the users and the manufacturers of the equipment.

SUMMARY OF THE INVENTION

The invention provides a simple and relatively inexpensive accessory which may be added to the conventional electric shaver. The invention forces the hairs to stand erect as the leading edge of the shaver approaches them whereby they are positively positioned to enter the openings in the screen and be sheared. The invention accomplishes this by providing a plate or panel which overlays the exterior surface of the screen and also partially overlays that portion of the screen openings which extend down the side of the screen. This edge catches the hairs which are lying at an acute angle to the skin surface and tips them into an erected position just as they enter the screen openings. Because of the relative planar positions of the edge of this panel and the effective shearing plane of the cutter blade, the hairs have no opportunity to return to their original position prior to being subjected to the shearing action of the blade.

In another embodiment of the invention, the panel member is positioned inside the screen between the screen and the blade. The straight top surface of the panel is positioned parallel to or just below the upper shearing plane of the blade and screen for positioning the hairs as they enter the screen.

In yet another embodiment of the invention, the blade structure is modified so as to incorporate spaced pairs of cutting edges, that is, cutting edges between each pair of cutting edges are removed and the panel is positioned within the blade structure with its upper surface extending to a plane just below the top of the cutting surface of the blade.

Finally, in the last mentioned embodiment, a further modification to the panel may include the provision of a serrated edge on the top surface of the panel to extend into the area between the spaced pairs of cutting edges. In each of the above-mentioned embodiments, the construction of the invention is such that it may be added as an accessory or modification to existing electric shavers without requiring redesign of the shaving head.

The invention will be more clearly understood upon reading the following description and the accompanying drawings.

BRIEF DESCRIPTION OF THE DRAWINGS

FIG. 8 is an enlarged fragmentary oblique view similar to FIG. 6 illustrating an alternate embodiment of the invention;

FIG. 9 is an enlarged sectional elevational view similar to FIG. 4 taken along the plane IX—IX of FIG. 8;

FIG. 10 is an elevational view of the hair raising panel with the blade removed from the screen structure;

FIG. 11 is a top view of the panel shown in FIG. 10 with the blade removed;

FIG. 12 is a fragmentary end view of the blade and panel illustrating a further modified panel;

FIG. 13 is a fragmentary sectional elevation illustrating a further modification of the invention with the hair raising panel mounted within the cutter blade;

FIG. 14 is a plan view of the blade shown in FIG. 12;

FIG. 15 is a top plan view of the blade and panel shown in FIGS. 13 and 14 illustrating the modification wherein alternate pairs of the cutting edges are removed;

FIG. 16 is an enlarged cross-sectional view taken along the plane XV—XV of FIG. 14;

FIG. 17 is an enlarged fragmentary view of a portion of the panel illustrating a further modification;

FIG. 18 is a side view of the modified panel shown in FIG. 17; and

FIG. 19 is a fragmentary sectional view similar to FIG. 9 illustrating a modified construction for a hair erecting panel.

DESCRIPTION OF A FIRST EMBODIMENT

Figure 1:
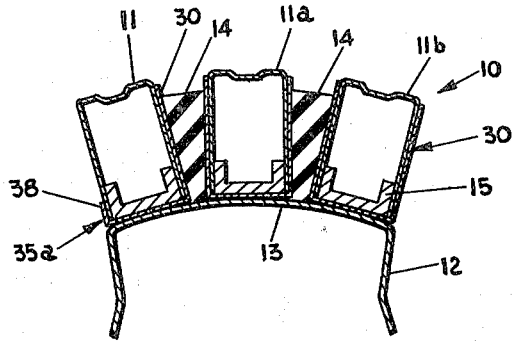
FIG. 1 is an enlarged sectional elevational view of a plural bladed shaver head showing the invention mounted on each of the individual screens of the head.

The numeral 10 indicates a shaver head having plural cutters. The shaver head has a plurality of screens 11, 11*a* and 11*b*, all mounted on a support bracket 12. The means of mounting is not illustrated since it is conventional and varies from one shaver brand to another. Further, it does not form any part of this invention. In this particular construction, the screens are arranged on an arched surface 13 to improve shaving action and the wedge-shaped spaces between the screens are occupied by suitable fillers 14.

Figure 4:
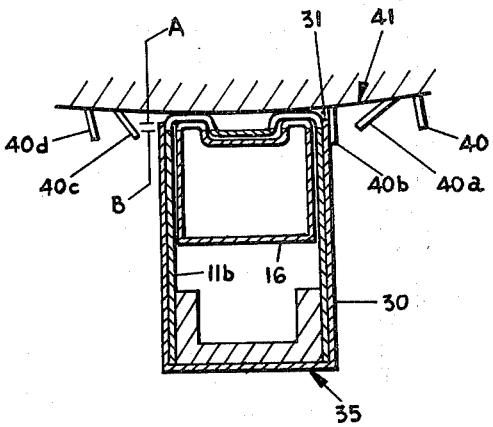
FIG. 4 is an enlarged, sectional elevational view of this invention mounted on a shaver screen illustrating the manner of its operation.
Figure 5:
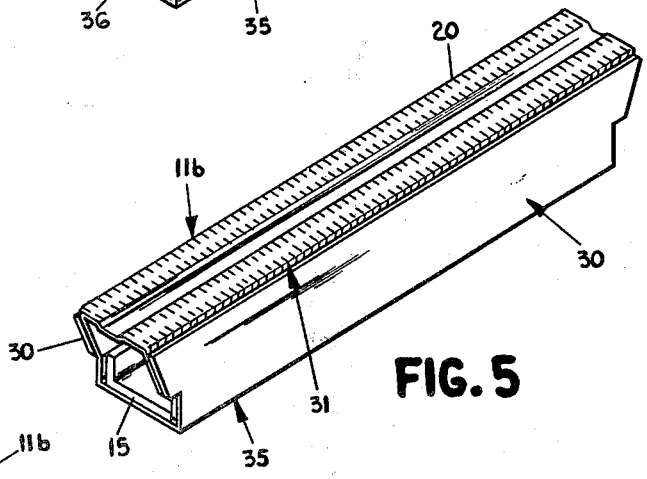
FIG. 5 is an oblique view of the invention mounted on a typical electric shaver screen.

The individual screens are of a generally inverted U-shape with the lower ends of the legs joined by a connecting member 15. As shown in FIG. 4, mounted within the screen is a cutting blade 16. The cutting blade is resiliently pressed against the inside surface of the screen by suitable means such as a coil or leaf springs. These are not illustrated since the springs are conventional, are found in commercial products and do not form any part of this invention.

The shaver head 10 is detachably mounted on a conventional shaver body which contains a motor and means extending into the shaver head to drive the cutting blade. In the particular form of shaver illustrated, the blade is reciprocated lengthwise of the screens. In other types of electric shavers, the screen is circular and the blade is rotated. Again, this is conventional structure and is not a part of this invention.

Figure 6:
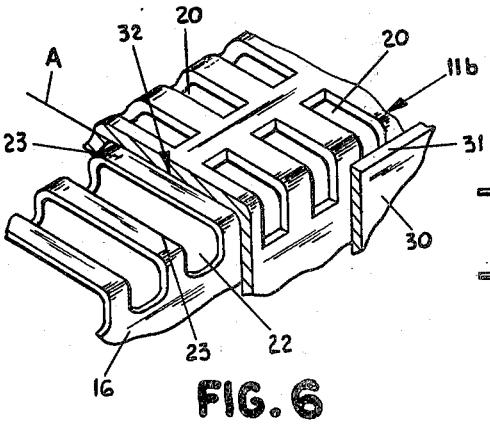
FIG. 6 is a very much enlarged, fragmentary, oblique view of the interrelationship of the top edge of the panel of this invention and the screen openings and top surface of the cutter blade.
Figure 3:
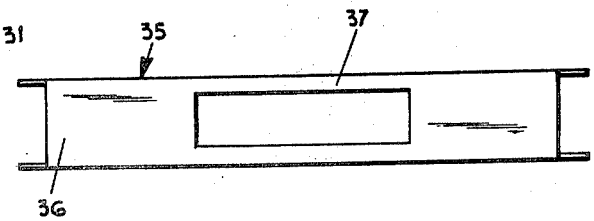
FIG. 3 is a bottom view of the panel shown in FIG. 2.

The top surface of the screen is provided with numerous, narrow, closely spaced, parallel openings 20. These openings extend to the outer side edges of the screen and then extend partially down the sides of the screen to form side portion openings as are shown in FIGS. 4 and 6. The blade 16 within the screen also has openings 22 which extend through the top of the blade and also a portion of the distance down the sides of the blades. The top edges of each of these openings are so shaped as to form cutting edges 23 on each side. As the blade 16 is moved back and forth past the openings 20 of the screen, hairs projecting through the openings in the screen are caught in the openings 22 of the blade and, by virtue of the cutting edges 23, are sheared.

Up to this point in the description, everything that has been described is conventional and can be found in one or more of the various makes of electric shavers commerically available on the market. This invention modifies the screen blade combination by providing a plate or panel 30 which seats tightly against the exterior surface of the screen. The top edge 31 of the panel 30 has a sharp corner (FIG. 6) at the juncture of the top face and the exterior face of the panel. The top edge 31 is straight and is positioned intermediate the bottoms of the side portions of the screen openings 20 and the inside surface 32 of the top of the screen. This surface lies in the plane A (FIG. 6), which plane not only is the inside surface of the top of the screen but is also the top surface of the cutter blade and, therefore, is the plane in which the cutting edges 23 perform their shearing function as they pass back and forth across the openings 20. The bottoms of the openings 22 are also arranged in a plane which is indicated by the letter B in FIG. 4. In FIG. 4, the spacing between the planes A and B is indicated. The preferred position for the top edge 31 of the panel 30 is in the plane A where it lies in the same plane as the inside surface 32 of the screen or, stated another way, in the same plane as the top of the cutting blade 16.

Figure 2:
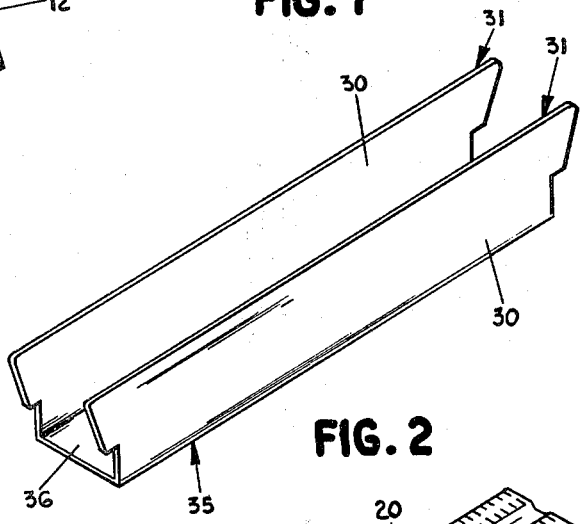
FIG. 2 is an oblique view of one form of the hair erecting panel of this invention.

The panel 30 may be a simple plate secured in any suitable manner such as by adhesives or fasteners to the sidewall of the screen. A preferred embodiment, however, is that of a U-shaped member 35 as illustrated in FIG. 2. The U-shaped member consists of a pair of panels 30 integrally connected by a base portion 36. The top edges 31 of the U-shaped member 35 are in the same plane and, as is clearly illustrated in FIG. 4, they partially overlay the lower part of the side portions of the screen openings when the screen is seated within the member 35 and bottomed against its base 36. The spacing between the panels 30 of the member 35 is such as to snugly receive the screen between them. The length of the member is at least that which will assure the top edges 31 extending to and beyond the end ones of the openings 20 in the screen. The precise length and depth of the member 35 will depend upon the length and depth of the screen and blade combination with which this invention is to be used.

The base 36 of the member 35 has a central aperture 37 to permit the driving finger or shaft of the shaver motor to project up into the blade-screen combination where it can engage and drive the blade.

A modified form of the invention is illustrated on the left hand side of FIG. 1 where the member **35*a* has one panel 30 of the type and height which has previously been described but the other side of the base portion has only a short, upstanding, integral flange 38. The height of this flange is only that which is sufficient to properly grip the screen 11 and firmly hold the member 35*a* in place. The reason for this modification is that while this invention greatly improves the shaving action of the shaver, it interferes with the use of the shaver as a trimmer. In this latter case, the hair is usually of a substantial length and the use of this invention interferes with the longer hairs entering the openings in the screen. Thus, by leaving one side open, the shaver can be improved in its shaving action without impairing its utility as a trimmer. Since the other blade-screen combinations of the same head have top edges 31 of the members 35** at the normal height, the shaver is capable of lifting the hairs when shaving as the shaver is moved in both directions.

It will be seen that the invention is a simple attachment which can be mounted on the conventional shaver screen-blade combination and need not have any special attachment means since the snug fit between the screen and the member will hold it in position. Since the screen is bottomed in the U-shaped member, the position of the top surface is automatically indexed in the plane A. The member 35 can be made of any suitable material but preferably is formed from stainless steel for appearance, durability and sanitation.

The principle of operation of the invention is illustrated in FIG. 4. In this figure, the individual hairs 40 through **40*d* are illustrated in various relationships to the skin surface 41. It will be noted that some of the hairs are growing at an acute angle to the skin surface such as the hairs 40*a* 40*c* and 40*d*. It is assumed that the hair 40*d* was originally inclined in the same direction as hair 40*a*. It is illustrated as about to enter the shaver as the shaver is being moved to the right. As the top edge 31 of the panel 30 engaged the end of the hair 40*b*,** it pushed the hair into an erected position by tipping it outwardly from the skin. Thus, the entire hair will be positioned, ready for cutting, rather than either passing between the exterior surface of the screen and the skin surface or only a portion of it projecting into the shearing plane A of the shaver.

As the hair **40*a* passes over the edge 31 of the panel 30, it will be bent in the opposite direction, that is, to the right as the invention is illustrated in FIG. 4. When the end of the hair has passed into the shaver beyond the top edge 31 of the panel, the natural resilience of the hair will tend to snap it back to its original, inclined position. As it does so, the blade will catch it and shear it. In the case of hairs inclined in the opposite direction, as in the case of hairs 40***c* and 40*d*, movement of the shaver in the opposite direction will result in their erection and thus will be sheared in the same manner as the hair 40*b*.

It will be seen that the use of the member 35*a* will not impair this action since hair passed over by the first screen-blade combination will be erected and sheared by the next two screen-blade combinations equipped with members 35.

It will be noted that the juncture of the top and sides of the screen is rounded. This is done to avoid the harsh scraping action which would result from the use of a sharp corner. This rounded juncture, however, tends to push the inclined hairs down against the skin since it has the effect of rolling over them. This invention provides a sharp cornered leading edge 31 which eliminates this rolling action. Because this sharp corner 31 is recessed slightly below the exterior top surface of the screen, it is prevented from scraping or irritating the skin but, at the same time, it is close enough to the skin surface to catch the hair and force it into erected position. Its sharpness eliminates the "rolling over" action of the leading edge of the screen.

Figure 7:
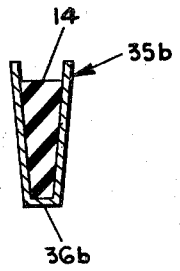
FIG. 7 is a cross-sectional view of a modified form of this invention.

FIG. 7 illustrates a modified form of this invention particularly adapted to the multiple blade-type shaver illustrated in FIG. 1. In this construction, the member 35*b*, instead of being seated around the screen-blade assembly, forms a V-shaped jacket around the space-filler 14. The height of the sides of the member 35*b* is such that their top edges are in the same position as the top edges of the member 35 and thus function in the same manner. The sides form a channel which snugly receives the filler. The member 35*b* is positively with respect to the screen-blade combination since the bottom 36*b* of the member seats against the support bracket 12. Since the top of the filler 14 is recessed, it will not interfere with the member's function. The thickness of the filler 14 holds the sides of the member firmly against the sides of the adjacent screens. When this modified arrangement is used, both leading edges of the shaver head will function as trimmers and the close shaving action will be performed by the inner edges of the screen-blade combination.

ALTERNATE EMBODIMENT OF THE INVENTION

Referring to FIGS. 8–11, an alternate embodiment of the invention is illustrated wherein the U-shaped panel member is positioned between the screen and the blade such that the top surface of the panel is positioned just below the upper shearing plane of the blade.

Since the structure illustrated is similar to that previously described, reference numerals corresponding to those of the previous description are utilized where possible. Similarly, the following description will describe in detail only those elements necessary to an understanding of the alternate embodiment. Where the corresponding components differ from those previously described, the reference numerals associated therewith will bear the prefix 100.

As illustrated in FIGS. 8 and 9, the U-shaped member 135 includes a panel 130 having a straight top edge 131 positioned within screen 11 between the screen and cutting blade 16. Panel 130 may be a simple plate-like member fixed in any suitable manner to the inner wall of the screen or to the outer wall of the cutter blade. Preferably, however, panel 130 is a generally U-shaped member 135 and is adapted to embrace the cutter blade. The blade moves with respect to the panel, however, as will be further explained hereinafter.

Referring additionally to FIG. 10, blade 16 is of conventional construction having openings 22 therein forming a plurality of cutting edges 23. A leaf spring element 50 depends downwardly from the bottom of the blade and extends generally along the length of the blade. The ends of spring 50 are secured to the bottom of the blade by tabs or the like (not shown) extending through suitable slots formed in the bottom of the blade. Between its ends, the spring extends generally downwardly and has an upwardly extending pocket 52 formed therein for receiving conventional drive finger elements (not shown) on the shaver housing. The engagement of the drive fingers in the pocket of the spring provides the means for driving the blade in a conventional fashion within the screen.

Panel 130 illustrated additionally in FIG. 11 is, as previously mentioned, generally U-shaped in cross-sectional configuration and includes a base portion 136 integrally connecting a pair of upstanding panels 130. The top edges 131 of the U-shaped member are in the same plane and, as illustrated in FIGS. 8, 9 and 10, partially overlay the lower part of the side portions of the screen and cutter blade openings when the blade is seated within the member 135 and bottomed against its base 136. Base 136 has an opening 54 through its central portion to receive that portion of spring 50 forming pocket 52. A pair of downwardly depending tabs 56 formed in base 136 engage the legs of spring 50 near their point of connection with the base of the blade. Tabs 56 are resilient and cooperate with spring 50 to bias member 135 upwardly such that base portion 136 engages the bottom surface of blade 16 to thus position the panel as shown in FIG. 9. Since the blade is bottomed in the U-shaped member, the position of the top surface 131 is automatically positioned at the proper level just below the interface of the cutting edges of the screen and blade. Member 135, as in the previous embodiment, preferably is formed from stainless steel for appearance, durability and sanitation.

In the embodiment of FIG. 12, panel 130*a* is a single plate-like member having preferably a sharpened top edge 131*a*. Panel 130*a* is fixed to the outer wall of the cutting blade 16 in any suitable manner as by an adhesive. Panel 130*a* extends along the length of the blade and the upper sharpened edge 131*a* is positioned at or just below the plane of the top of the cutting edges 22.

In another embodiment of the invention shown in FIGS. 13, 14 and 15, the panel member 230 is positioned within the interior of the blade 216. The modification of this embodiment includes, in addition to the positioning of the panel member within the blade, the further provision of spaced pairs of cutting edges 223*a*, 223*b*, etc. The cutting elements between each spaced pair 223 have been removed. The enlarged openings between the spaced pairs of cutting edges provide additional clearance to receive the angularly disposed facial hairs and the like. Conventionally, there is sufficient excursion or travel of the cutting blade within the screen such that there is a cooperative cutting relationship between the spaced pairs of cutter blades with each of the corresponding cooperative openings in the screen.

When the blade 216 has been modified as illustrated in FIGS. 14 and 15, a U-shaped member 235, as shown in FIG. 13, is positioned therein such that its base portion 236 rests on the bottom of the inside surface of the blade 216. The sidewalls 230 of the panel extend upwardly to a position adjacent the inside surface at the top of the cutting edges 223.

To further enhance the cutting ability of the panel mounted within the blade, the panel 330, as shown in the fragmentary views of FIGS. 16, 17 and 18, may have a serrated top surface or upper edge 331 such that the serrations extend upwardly between the spaced pairs of cutting edges. Preferably, the serrated portions 331 are offset slightly (FIGS. 16 and 18) so as to extend outwardly from within the cutter through the removed portion between the adjacent pairs of cutting edges 223. The serrated edge portion has the additional advantage in that it engages the facial hairs as they pass between the slots formed in screen 11.

Although the invention has been described with respect to positioning the panel on each side of the screen or the blade, it will be appreciated that, if desired, one side can be left open whereby the shaver can be improved in its shaving action without impairing its utility as a trimmer. This construction is illustrated in FIG. 19 where a panel 135*a* is provided on one side only.

It will be seen that by the use of this invention, a very close shave can be obtained quickly by passing the head back and forth across the skin surface. Further, the shaver will be much more complete since all of the hairs will be positioned such that they will be sheared. The invention is useful not only in the case of hairs which are growing at an angle, but also in the case of hair which is extremely fine and therefore lacks the necessary stiffness to stand erect. This type of hair tends to lay over toward the skin and this invention will force these hairs into an outwardly projecting posture where they will be sheared by the blade.

It will be recognized that this invention can be applied to various types and makes of electric shavers either as original equipment or as an accessory to modify existing shaver heads. As such, the invention solves a problem which has not heretofore been satisfactorily answered in the electric shaver art.

The embodiments of the invention in an exclusive property or privilege is claimed are defined as follows:

1. In a cutting head for an electric shaver having a thin screen and a driven cutting blade movably mounted within and engaging the inside top surface of said screen, said screen having a top surface and a pair of sides, a plurality of openings through the top of said screen, portions of said openings extending down said slides through which individual hairs may pass to be sheared by said blade, the improvement in said cutting head comprising: a thin panel of rigid material positioned between said blade and said screen, said panel extending parallel to and seated tightly against an inner side face of said screen, the top edge of said panel abutting said inner side face of said screen and being spaced from and parallel with said inside top surface of said screen and overlaying the lower part of those portions of said openings extending down said side of said screen for erecting individual hairs into a posture generally normal to the skin as the hairs pass through said openings in said screen for shearing by said blade.

2. The improvement in electric shaver cutting heads as described in claim 1, wherein a pair of said panels are provided, one on each side of said screen.

3. The improvement in electric shaver cutting heads as described in claim 1 wherein said panel has an integral base portion generally normal to the plane of said panel and projecting from the lower edge of said panel, an upturned flange integral with an edge of said base portion parallel with said panel and spaced therefrom a distance such that said blade may be snugly seated between said panel and said flange.

4. The improvement in electric shave cutting heads as described in claim 3 wherein resilient biasing means is provided on said base portion to position said panel on said blade.

5. The improvement in electric shaver cutting heads as described in claim 1 wherein said panel has an integral base portion generally normal to the plane of said panel and projecting from the lower edge of said panel, an upturned flange integral with an edge of said base portion parallel with said panel and spaced therefrom a distance such that said blade may be seated between said panel and said flange with said flange extending parallel to and seated against the adjacent inner side face of said screen, said flange being the same height as said panel and serving as a second panel for erecting hairs when the direction of movement of the shaver over the skin surface is reversed.

6. The improvement in electric shaver cutting heads as described in claim 5 wherein resilient biasing means is provided on said base portion to position said panel on said blade.

7. In a cutting head for an electric shaver having a thin screen and a driven cutting blade movably mounted within and engaging the inside surface of said screen, said screen and said blade each having a top surface and a pair of sides, a plurality of openings through the top of said screen and said blade, portions of said openings extending down said sides through which individual hairs may pass through said screen to be sheared by said blade, the improvement in said cutting head comprising: a thin panel of rigid material positioned between said screen and said blade, said panel extending parallel to and seated against an inner side face of said screen, the top edge of said panel abutting said inner side face of said screen and being parallel with the top surfaces of said screen and said blade and located above the bottom ends of the portions of said screen and said blade openings in said sides of said screen and said blade and below the horizontal plane of the inside surface of the top of said screen for erecting individual hairs into a posture generally normal to the skin as the hairs pass into said openings in the screen for shearing by the blade.

8. The improvement in electric shaver cutting heads as described in claim 7 wherein a pair of said panels are provided, one on each side of said blade.

9. The improvement in electric shaver cutting heads as described in claim 8 wherein said pair of panels are separated by a base portion and further including resilient biasing means on said base portion to position said panels on said blade.

10. The improvement in electric shaver cutting heads as described in claim 7 wherein said screen is elongated, of inverted U-shape and said openings extend laterally thereof, said panel being elongated and of a length to overlay all openings in said side face of said screen.

11. The improvement in electric shaver cutting heads as described in claim 10 wherein a plurality of said screen-blade combinations are provided, arranged parallel to each other, said panels being provided on each inner side of each of said screens except one inner side of one of said screens, said one inner side being the leading edge of said shaver head when the shaver is moved in one direction.

12. In a cutting head for an electric shaver having a thin screen and a driven cutting blade movably mounted within and engaging the inside surface of said screen, said screen and said blade each having a top surface and a pair of sides, a plurality of openings through said top surfaces of said screen and said blade, portions of said openings extending down said sides through which individual hairs may pass to be sheared by said blade, the improvement in said cutting head comprising: a thin, rigid element fixed within said blade for movement therewith and seated against an inner side face of said blade, the top edge of said element being parallel with the top surface of said blade and in the same general horizontal plane as the inside surface of said top surface of said blade and overlaying the lower part of those portions of said openings extending down said sides of said blade for erecting individual hairs into a posture generally normal to the skin as the hairs pass through said openings.

13. The improvement in electric shaver cutting heads as described in claim 12 wherein said blade is elongated, of inverted U-shape and said openings extend laterally thereof, said element being elongated and of a length to overlay all openings in said side face of said blade.

14. The improvement of claim 13 wherein said openings through said blade form a plurality of cutting edges, said cutting edges being arranged as a plurality of spaced pairs of said cutting edges, each spaced pair being separated from an adjacent spaced pair of distance equal to the width of one pair of said cutting edges.

15. The improvement of claim 14 wherein at least portions of said top edge of said element are serrated.

16. The improvement of claim 15 wherein at least some of the serrations on said top edge are offset to extend outwardly toward said screen through said side face of said blade between said spaced pairs of cutting edges.

* * * * *

UNITED STATES PATENT AND TRADEMARK OFFICE

CERTIFICATE OF CORRECTION

PATENT NO. : 4 003 130

DATED : January 18, 1977

INVENTOR(S) : James E. Rookus

It is certified that error appears in the above-identified patent and that said Letters Patent are hereby corrected as shown below:

Column 5, line 34:

After "positively" insert -- positioned --

Column 7, line 49:

"slides" should be -- sides --

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*